United States Patent [19]

Swartwood

[11] Patent Number: 4,605,360

[45] Date of Patent: Aug. 12, 1986

[54] REVERSIBLE EXPANSIBLE CHAMBER HYDRAULIC PUMP

[76] Inventor: James M. Swartwood, 7927 Lazy S. La. NE., Bremerton, Wash. 98310

[21] Appl. No.: 696,166

[22] Filed: Jan. 29, 1985

[51] Int. Cl.[4] ..... F04B 19/22; F04B 21/02

[52] U.S. Cl. ..... 417/518; 137/625.25

[58] Field of Search ..... 417/510, 516–520; 91/481; 137/625.25, 624.13; 251/251, 263

[56] References Cited

U.S. PATENT DOCUMENTS

| | | | |
|---|---|---|---|
| 141,394 | 7/1873 | Snell | 417/518 |
| 1,414,965 | 5/1922 | Mayer | 91/481 |
| 3,057,301 | 10/1962 | Varga | 417/518 |
| 3,058,431 | 10/1962 | Eddy | 417/518 |

FOREIGN PATENT DOCUMENTS

| | | | |
|---|---|---|---|
| 233346 | 5/1964 | Austria | 417/518 |
| 254111 | 11/1912 | Fed. Rep. of Germany | 417/519 |

*Primary Examiner*—Carlton R. Croyle
*Assistant Examiner*—Theodore Olds

[57] ABSTRACT

A reversible, positive displacement, expansible chamber hydraulic pump with only three moving parts. Intended for manual operation where the creation of high fluid pressures is desired, the pump consists of a rotating input shaft with a single eccentric cam. The cam operates both a piston and a slide valve which are located at a relative angle of ninety degrees from one another about the axis of the cam. The slide valve controls fluid flow to and from the pump cylinder such that fluid flow reverses upon reversal of rotation of the input shaft and such that fluid flow is blocked when the piston is at top or bottom dead center.

1 Claim, 4 Drawing Figures

REVERSIBLE EXPANSIBLE CHAMBER HYDRAULIC PUMP

BACKGROUND

This invention relates to pumps and in particular to positive displacement hydraulic pumps of the expansible chamber type. Manual hydraulic pumps which are not reversible have existed for a long time. Numerous other positive displacement pumps also exist but they are of more complex construction and although sometimes capable of manual or reversible operation were not designed or intended for either. This invention is intended to satisfy the need for a low-cost manually operated, reversible, positive-displacement hydraulic pump of simple construction. Used in a hydraulic vise, hydraulic press, or in applications where large forces are necessary to precisely position machinery or pieces of work, this pump is capable of developing both high pressures and small displacements with greater accuracy and less actuating force than are possible by non-hydraulic mechanical means alone.

A number of previous patents, listed below, disclose pumps nearest in function to the pump here presented but not of similar design nor based upon the same principle of operation.

| U.S. Pat. No. | Patentee | Date of Patent |
|---|---|---|
| 720,872 | S. E. Alley | 11/08/02 |
| 1,691,744 | W. B. Van Arsdel | 5/13/25 |
| 1,719,693 | H. Ernst | 9/15/27 |
| 1,799,449 | G. F. Woelfel | 3/01/28 |
| 1,819,285 | W. Fourness | 2/20/28 |
| 2,806,431 | E. Woydt | 2/10/56 |
| 3,057,301 | J. M. J. Varga | 12/13/60 |

Alley discloses what appears to be the first use of cam-actuated sliding valves. Two valves are used instead of one, operated by separate cams.

Van Arsdel discloses the use of two pistons and a single two-way slide valve but uses separate mechanisms for actuation of the pumping members and valve.

Ernst, like Van Arsdel, discloses the use of a two-way inlet and discharge slide valve but actuated by a crank which is separate from the pumping member crank.

Woelfel discloses cam actuated slide valves and crank operated pistons.

Fourness discloses, in a compressor, cam operated slide valves and cam operated pistons, using separate cams.

Woydt discloses a cam actuated piston and a single slide valve operated by an arrangement of gears, chains, and sprockets.

Varga discloses a single cam which directly actuates a piston but operates through a rocker mechanism to actuate the slide valve in such a manner as to achieve a variable stroke pump.

None of the above patents discloses a pump which is intended to be either reversible or manually operated. None of the above patents discloses a pump design which is based upon the same operating principle, which is as simple, or has as few moving parts as the pump here disclosed. None of the above patents discloses a pump which would be of such economical manufacture and maintenance as the one here disclosed.

SUMMARY OF THE INVENTION

The disclosed pump overcomes expense of manufacture and difficulty of maintenance through simplicity of design. The direct actuation of both the piston and the sliding valve by the same cam limits the number of moving parts to three. The use of a sliding valve eliminates the need for a check valve to maintain pressure. The reversibility of the pump eliminates the need for a release valve and return mechanism for the application device (vise, press, etc.), and increases the overall versatility of application of the pump. The use of a single cam which may be perfectly circular further minimizes production costs. The design also allows complete disassembly of the pump with only the removal of the input shaft.

DESCRIPTION OF THE PREFERRED EMBODIMENT

Figure 1:
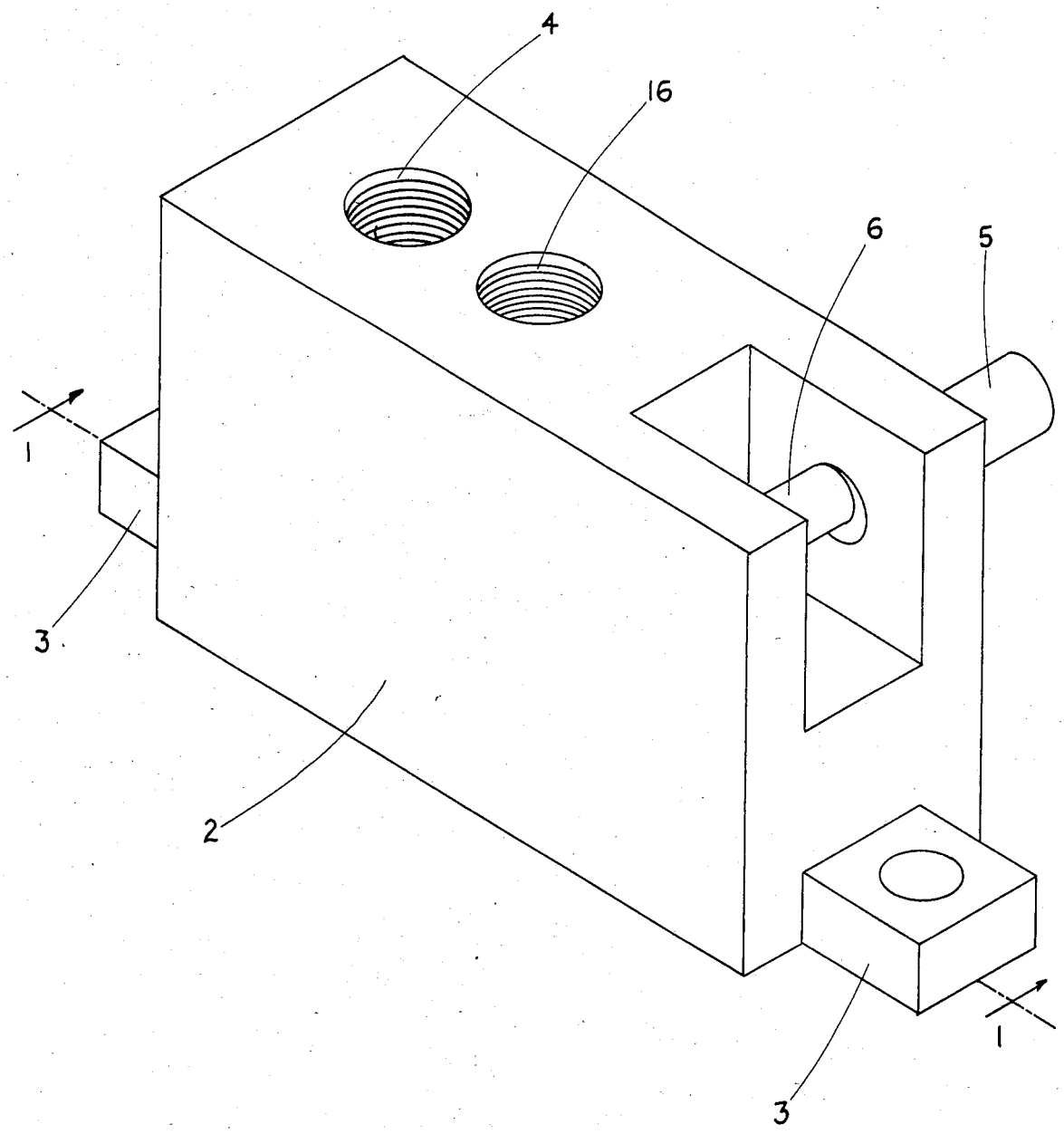
FIG. 1 is a perspective view of a pump according to a typical embodiment of the present invention.

For the purpose of conveying an understanding of the principles of this invention reference will be made to the embodiment illustrated in the drawings and specific language will be used to describe same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, the pump consists of a single body of material 2 machined with mounting flanges 3, and threaded inlet/outlet ports 4 and 16 to which hydraulic lines may be connected. A rotating input shaft 5 is provided with an eccentic cam 6. The input shaft would in most manual applications be extended and provided with a handle or handles such that the shaft could be conveniently rotated in either direction.

Figure 2:
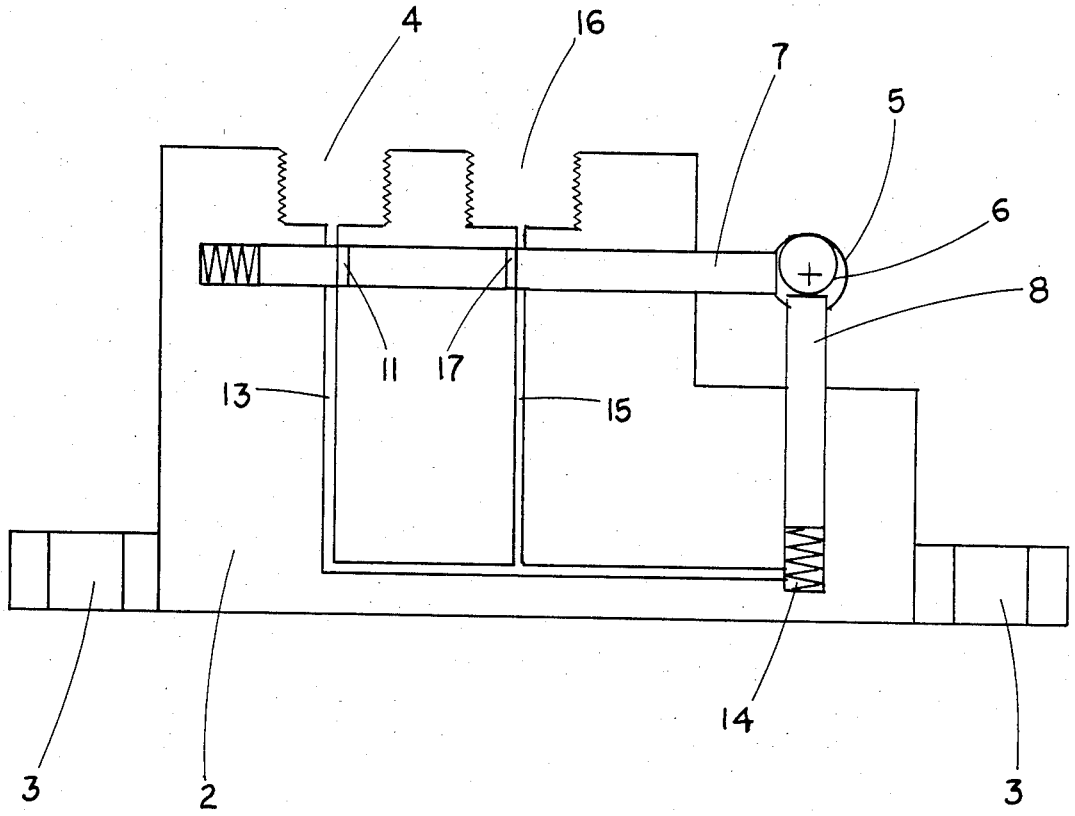
FIG. 2 is a section view of the pump illustrated in FIG. 1 taken along line 1—1.

FIG. 2 illustrates a cross-section of the embodiment shown in FIG. 1 along section line 1—1, showing in addition to input shaft 5 and eccentric cam 6 the cylindrical unitary inlet/discharge slide valve body 7, the cylindrical piston 8, and their respective helical return springs which serve to maintain both slide valve body 7 and piston 8 in constant contact with eccentric cam 6. Connecting drilled passageways 13 and 15 for the transport of fluid between inlet/discharge ports 4 and 16, slide valve body 7 and expansible pumping chamber 14 are shown. Both slide valve body 7 and piston 8 consist of cylindrical solids, the former being provided with two annular grooves 11 and 17 to permit the passage of fluid between inlet/discharge ports 4 and 16 and internal passageways 13 and 15 respectively whenever slide valve body 7 is moved to either side of its center neutral position.

Figure 3:
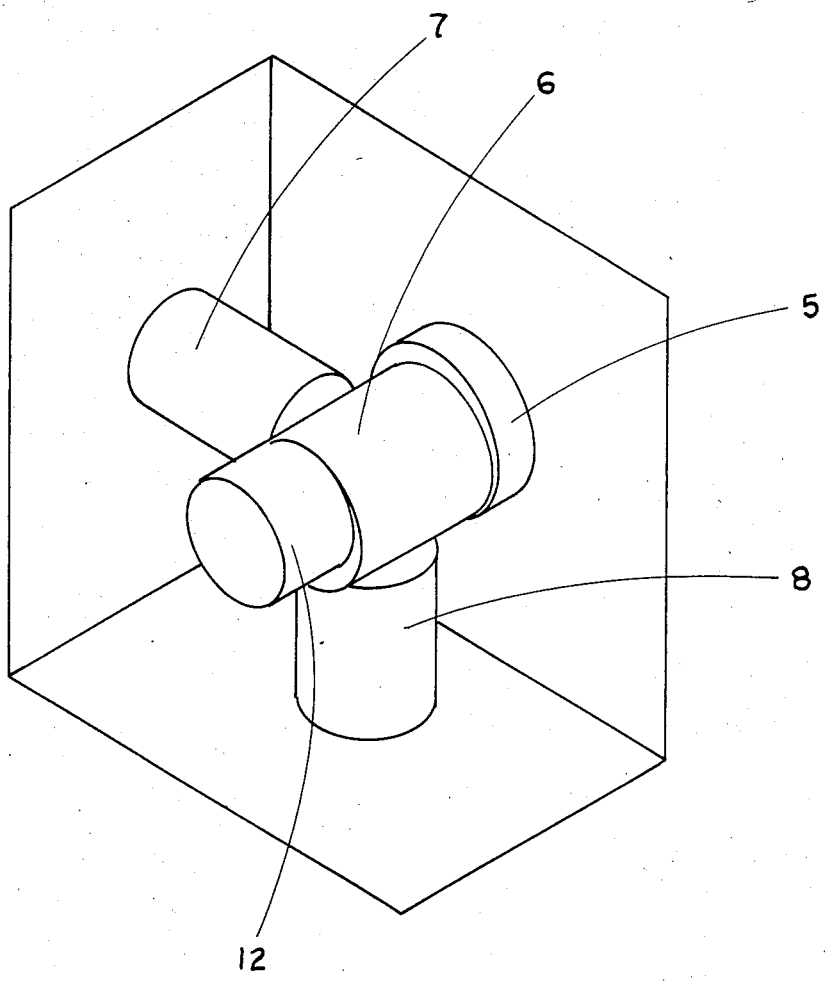
FIG. 3 is a detail perspective view of the working parts of the pump illustrated in FIG. 1, with the near pump body side eliminated to afford an unobstructed view.

FIG. 3 illustrates, in a cutaway view from the same perspective as FIG. 1, details of the relationship between input shaft 5, eccentric cam 6, slide valve body 7 and piston 8. Valve body 7 and piston 8 ride along the same cam surface 6 at a relative angle of ninety degrees from one another. The ninety degree angle between slide valve body 7 and piston 8 is basic to the design of this pump and critical to its operation in that it creates a ninety degree phase angle difference in the movement of those two parts, resulting in slide valve body 7 being in its neutral or closed position when piston 8 is at rest at its top dead center and bottom dead center positions and further resulting in slide valve body 7 being at its position of maximum excursion, or fully open at one port or another, when piston 8 is at mid-stroke and at maximum velocity. Bearing surface 12 is concentric with input shaft 5 and would extend into and be supported by the side of pump body 2 which has been eliminated from FIG. 3.

Figure 4:
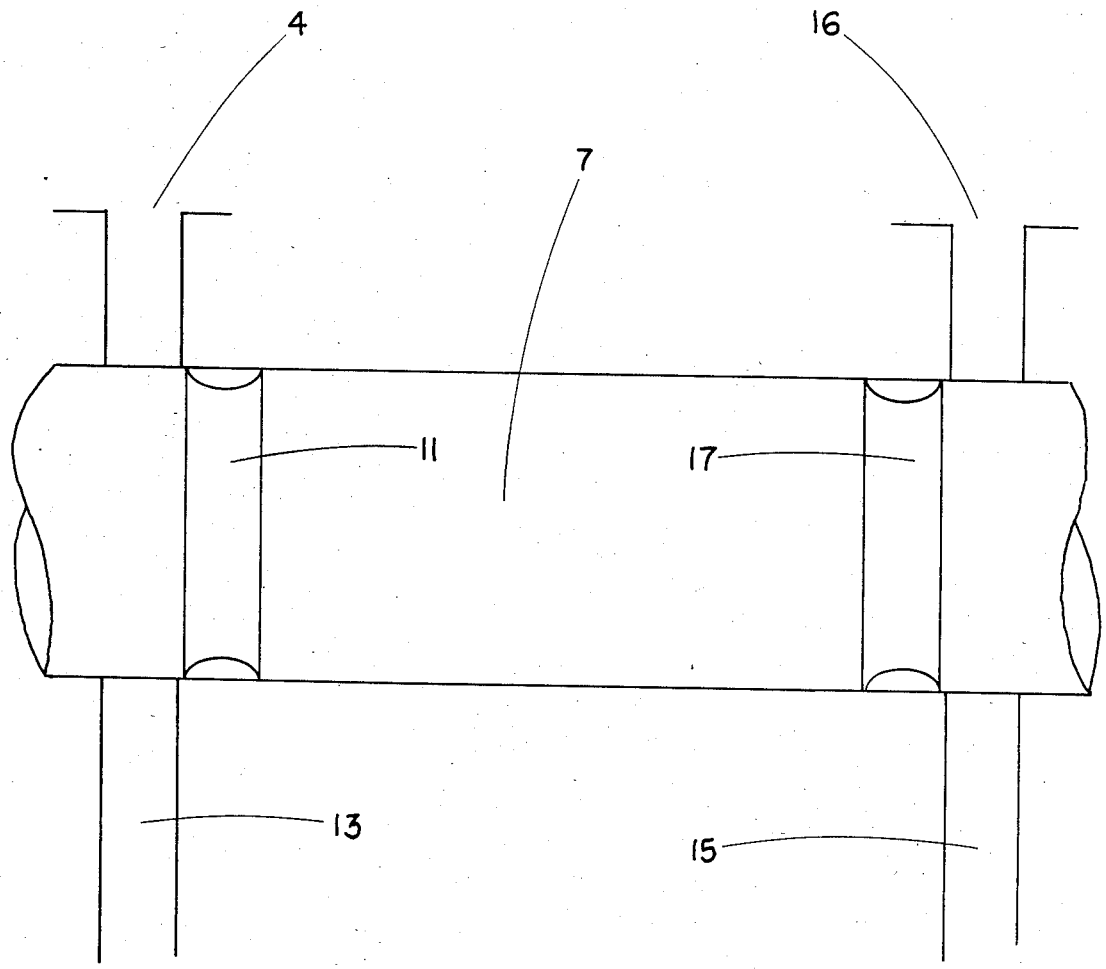
FIG. 4 is a detail section view of the slide valve body, comprising a portion of the FIG. 2 section.

FIG. 4 illustrates in detail slide valve body 7 shown in cross-section in FIG. 2. The relationship between slide valve body annular grooves 11 and 17, inlet/discharge ports 4 and 16 and connecting passageways 13 and 15 to pump chamber 14 are shown in detail. Valve body 7 is constructed such that at its rightmost excursion annular groove 17 is fully aligned with drilled passageway 15 and inlet/discharge port 16, at its leftmost excursion annular groove 11 is fully aligned with passageway 13 and inlet/discharge port 4, and at its center or neutral position both passageways and ports are blocked.

DESCRIPTION OF OPERATION

In operation, it can be seen from FIG. 2 that as actuating shaft 5 rotates in a clockwise direction slide valve body 7 will move toward the right while piston 8 is driven downward, causing fluid to be expelled under pressure from expansible pumping chamber 14 via passageway 15 and annular groove 17 then out inlet/discharge port 16. As piston 8 approaches bottom dead center slide valve body 7 returns to its neutral position, closing both ports.

Further clockwise rotation of input shaft 5 causes slide valve body 7 to move to the left, opening inlet/discharge port 4 to admit fluid while piston 8 rises to expand pumping chamber 14. Clockwise rotation of input shaft 5 thus causes fluid to be drawn into inlet/discharge port 4 and expelled under pressure from inlet/-discharge port 16.

Referring again to FIG. 2 it can be seen that counterclockwise rotation of input shaft 5 will cause downward movement of pumping member 8 while simultaneously moving slide valve body 7 to the left, permitting fluid under pressure to be expelled from inlet/discharge port 4. Further counterclockwise rotation of input shaft 5 will return slide valve body 7 to its neutral position as piston 8 reaches bottom dead center. As input shaft 5 rotates yet further in a counterclockwise direction slide valve body 7 will move to the right, opening inlet/discharge port 16 for the admission of fluid as piston 8 rises to expand pumping chamber 14. Fluid flow between inlet/discharge ports 4 and 16 is thereby reversed upon reversal of rotation of input shaft 5.

When input shaft 5 is positioned as shown in FIG. 2 such that piston 8 is at top dead center and slide valve body 7 is at its neutral or closed position, a condition of stability is achieved such that all fluid flow is blocked, effecting a hydraulic lock.

What is claimed is:

1. A reversible, expansible chamber hydraulic pump comprising, a pump block, first and second fluid ports disposed in said block, a rotating input shaft having an axis of rotation, said input shaft having an eccentric cam, a pump piston reciprocating in a pump chamber, a reciprocating slide valve, said pump piston and said slide valve both being disposed perpendicular to said input shaft, said pump piston and said slide valve being actuated by said eccentric cam, said pump piston and said slide valve being disposed perpendicular to each other, fluid passages being provided such that said reciprocating slide valve alternately communicates one of said ports to the pump chamber, and at the same time blocks communication between the other port and the pump chamber.

* * * * *